US007866940B2

(12) United States Patent
Stones et al.

(10) Patent No.: US 7,866,940 B2
(45) Date of Patent: Jan. 11, 2011

(54) VACUUM PUMP

(75) Inventors: Ian David Stones, Burgess Hill (GB); Nigel Paul Schofield, Horsham (GB); Martin Nicholas Stuart, Shoreham-by-Sea (GB)

(73) Assignee: Edwards Limited, Crawley, West Sussex (GB)

( * ) Notice: Subject to any disclaimer, the term of this patent is extended or adjusted under 35 U.S.C. 154(b) by 1243 days.

(21) Appl. No.: 10/574,027

(22) PCT Filed: Sep. 23, 2004

(86) PCT No.: PCT/GB2004/004046

§ 371 (c)(1),
(2), (4) Date: Mar. 23, 2006

(87) PCT Pub. No.: WO2005/040615

PCT Pub. Date: May 6, 2005

(65) Prior Publication Data

US 2007/0116555 A1 May 24, 2007

(30) Foreign Application Priority Data

Sep. 30, 2003 (GB) ..... 0322888.9
Apr. 23, 2004 (GB) ..... 0409139.3

(51) Int. Cl.
*F04D 29/42* (2006.01)

(52) U.S. Cl. ..... 415/55.6; 415/90; 415/143

(58) Field of Classification Search ..... 415/55.6, 415/90, 143; 417/423.4

See application file for complete search history.

(56) References Cited

U.S. PATENT DOCUMENTS 5,695,316 A * 12/1997 Schutz et al. ..... 415/90

(Continued)

FOREIGN PATENT DOCUMENTS

DE 3531942 A1 4/1986

(Continued)

OTHER PUBLICATIONS

Volker Drexel, Peter Gnauck, abstract of DE10032607 A, Jan. 24, 2002; Leo Elektronenmikroskopie GmbH.

(Continued)

*Primary Examiner*—Edward Look
*Assistant Examiner*—Aaron R Eastman

(57) ABSTRACT

A differentially pumped mass spectrometer system comprises a mass spectrometer having a plurality of pressure chambers; a vacuum pump attached thereto and comprising at least three pump inlets, a first pumping section, a second pumping section downstream from the first pumping section, and a third pumping section downstream from the second pumping section, an outlet from a first, relatively low, pressure chamber being connected to a first pump inlet through which fluid can enter the pump from the first chamber and pass through the first, second and third pumping sections towards a pump outlet, an outlet for a second, medium pressure chamber of the spectrometer being connected to a second pump inlet through which fluid can enter the pump and pass through, of said sections, only the second and third pumping sections towards the pump outlet, and an outlet for a third, highest pressure chamber of the spectrometer being connected to a third pump inlet through which fluid can enter the pump and pass through, of said sections, only at least part of the third pumping section towards the pump outlet; and a backing pump connected to the pump outlet such that, in use, at least 99% of the fluid mass pumped from the spectrometer passes through both the vacuum pump and the backing pump.

17 Claims, 5 Drawing Sheets

U.S. PATENT DOCUMENTS

| | | | | |
|---|---|---|---|---|
| 5,707,213 | A * | 1/1998 | Conrad | 417/53 |
| 5,733,104 | A * | 3/1998 | Conrad et al. | 417/44.1 |
| 6,106,223 | A * | 8/2000 | Leyshon | 415/90 |
| 6,135,709 | A * | 10/2000 | Stones | 415/90 |
| 6,193,461 | B1 | 2/2001 | Hablanian | |
| 6,409,477 | B1 * | 6/2002 | Blecker et al. | 417/199.1 |
| 2002/0100313 | A1 | 8/2002 | Abbel | |
| 2004/0265152 | A1 * | 12/2004 | Gotta et al. | 417/423.4 |
| 2006/0099094 | A1 * | 5/2006 | Schofield | 417/423.4 |
| 2006/0140794 | A1 * | 6/2006 | Schofield | 417/423.4 |
| 2006/0140795 | A1 * | 6/2006 | Schofield | 417/423.4 |
| 2006/0153715 | A1 * | 7/2006 | Schofield | 417/423.4 |
| 2007/0116555 | A1 * | 5/2007 | Stones et al. | 415/90 |
| 2008/0063541 | A1 * | 3/2008 | Stones | 417/250 |

FOREIGN PATENT DOCUMENTS

| | | | |
|---|---|---|---|
| EP | 1 302 667 | A | 4/2003 |
| FR | 2 262 742 | A | 9/1975 |
| JP | 63075386200253658 | A | 10/2002 |
| WO | WO 02/05310 | A | 1/2002 |

OTHER PUBLICATIONS

Takeyasu Noboru, Hayashi Yoshitaka, PAJ abstract of JP 2136595 A, "Vacuum Pump," May 25, 1990; Anelva Corp.

United Kingdom Search Report of Application No. GB 0322888.9; Date of Search: Mar. 22, 2004.

United Kingdom Search Report of Application No. GB 0322888.9; Date of Search: Jun. 21, 2004.

PCT Invitation to Pay Additional Fees of International Application No. PCT/GB2004/004046; Date of mailing: Feb. 7, 2005.

PCT International Search Report of International Application No. PCT/ GB2004/004046; Date of mailing of the International Search Report: Apr. 22, 2005.

PCT Written Opinion of the International Searching Authority of International Application No. PCT/GB2004/004046; Date of mailing: Apr. 22, 2005.

* cited by examiner

VACUUM PUMP

FIELD OF THE INVENTION

This invention relates to a vacuum pump and in particular a compound vacuum pump with multiple ports suitable for differential pumping of multiple chambers.

BACKGROUND OF THE INVENTION

In a differentially pumped mass spectrometer system a sample and carrier gas are introduced to a mass analyser for analysis. One such example is given in FIG. 1. With reference to FIG. 1, in such a system there exists a high vacuum chamber 10 immediately following first, (depending on the type of system) second, and third evacuated interface chambers 11, 12, 14. The first interface chamber is the highest-pressure chamber in the evacuated spectrometer system and may contain an orifice or capillary through which ions are drawn from the ion source into the first interface chamber 11. The second, optional interface chamber 12 may include ion optics for guiding ions from the first interface chamber 11 into the third interface chamber 14, and the third chamber 14 may include additional ion optics for guiding ions from the second interface chamber into the high vacuum chamber 10. In this example, in use, the first interface chamber is at a pressure of around 1-10 mbar, the second interface chamber (where used) is at a pressure of around $10^{-1}$-1 mbar, the third interface chamber is at a pressure of around $10^{-2}$-$10^{-3}$ mbar, and the high vacuum chamber is at a pressure of around $10^{-5}$-$10^{-6}$ mbar.

The high vacuum chamber 10, second interface chamber 12 and third interface chamber 14 can be evacuated by means of a compound vacuum pump 16. In this example, the vacuum pump has two pumping sections in the form of two sets 18, 20 of turbo-molecular stages, and a third pumping section in the form of a Holweck drag mechanism 22; an alternative form of drag mechanism, such as a Siegbahn or Gaede mechanism, could be used instead. Each set 18, 20 of turbo-molecular stages comprises a number (three shown in FIG. 1, although any suitable number could be provided) of rotor 19*a*, 21*a* and stator 19*b*, 21*b* blade pairs of known angled construction. The Holweck mechanism 22 includes a number (two shown in FIG. 1 although any suitable number could be provided) of rotating cylinders 23*a* and corresponding annular stators 23*b* and helical channels in a manner known per se.

In this example, a first pump inlet 24 is connected to the high vacuum chamber 10, and fluid pumped through the inlet 24 passes through both sets 18, 20 of turbo-molecular stages in sequence and the Holweck mechanism 22 and exits the pump via outlet 30. A second pump inlet 26 is connected to the third interface chamber 14, and fluid pumped through the inlet 26 passes through set 20 of turbo-molecular stages and the Holweck mechanism 22 and exits the pump via outlet 30. In this example, the pump 16 also includes a third inlet 27 which can be selectively opened and closed and can, for example, make the use of an internal baffle to guide fluid into the pump 16 from the second, optional interface chamber 12. With the third inlet open, fluid pumped through the third inlet 27 passes through the Holweck mechanism only and exits the pump via outlet 30. In this example, the first interface chamber 11 is connected to a backing pump 32, which also pumps fluid from the outlet 30 of the compound vacuum pump 16. The backing pump typically pumps a larger mass flow directly from the first chamber 11 than that from the outlet of the secondary vacuum pump 30. As fluid entering each pump inlet passes through a respective different number of stages before exiting from the pump, the pump 16 is able to provide the required vacuum levels in the chambers 10, 12, 14, with the backing pump 32 providing the required vacuum level in the chamber 11.

The backing pump 32 is typically a relatively large, floor standing pump. Depending on the type of backing pump used, the performance provided by the backing pump at the first interface chamber 11 can be significantly affected by the operational frequency. For example, a direct on line backing pump running from a 50 Hz electrical supply can produce a performance in the first chamber 11 as much as a 20% lower than the performance produced by the same pump operating at 60 Hz. As the remaining chambers 10, 12, 14 are all linked to the first chamber 11, any change in the performance in the first chamber 11 would have a significant affect on the performance in the other chambers.

In at least its preferred embodiments, the present invention seeks to solve these and other problems.

BRIEF SUMMARY OF THE INVENTION

In a first aspect, the present invention provides a differentially pumped vacuum system comprising apparatus, for example, a mass spectrometer, having at least first and second chambers; and a vacuum pump for differentially pumping fluid from the chambers to generate a first pressure above 0.1 mbar, preferably above 1 mbar, in the first chamber and a second pressure lower than the first pressure in the second chamber, the pump comprising at least first and second pump inlets each for receiving fluid from a respective pressure chamber and a plurality of pumping stages positioned relative to the inlets so that fluid received from the first chamber passes through fewer pumping stages than fluid from the second chamber, the inlets being attached to the apparatus such that at least 99% of the fluid mass pumped from the apparatus passes through at least one of the pumping stages of the pump.

The differentially pumped vacuum system may have additional, lower pressure chambers than those described above, which may be pumped by the same pumping arrangement or by a separate pumping arrangement. However, in either case, the fluid mass pumped through these additional lower pressure chambers is typically much less than 1% of the total system mass flow.

Each pumping stage preferably comprises a dry pumping stage, that is, a pumping stage that requires no liquid or lubricant for its operation.

In one embodiment, the apparatus comprises a third chamber, and the pump comprises a third inlet for receiving fluid from the third chamber to generate a third pressure lower than the second pressure in the third chamber, the pumping stages being arranged such that fluid entering the pump from the third chamber passes through a greater number of pumping stages than fluid entering the pump from the second chamber. In other words, in this embodiment the pump comprises at least three pump inlets, an outlet from a first, relatively high, pressure chamber being connected to a first pump inlet, an outlet for a second, medium pressure chamber being connected to a second pump inlet, and an outlet for a third, relatively low pressure chamber being connected to a third pump inlet.

Preferably, the pump comprises at least three pumping sections, each comprising at least one pumping stage, for differentially pumping the first to third chambers. The pump preferably comprises a first pumping section, a second pumping section downstream from the first pumping section, and a third pumping section downstream from the second pumping section, the sections being positioned relative to the inlets such that fluid entering the pump from the third chamber passes through the first, second and third pumping sections, fluid entering the pump from the second chamber passes through, of said sections, only the second and third pumping sections, and fluid entering the pump from the first chamber passes through, of said sections, only at least part of the third pumping section.

Preferably at least one of the first and second pumping sections comprises at least one turbo-molecular stage. Both of the first and second pumping sections may comprise at least one turbo-molecular stage. The stage of the first pumping section may be of a different size to the stage of the second pumping section. For example, the stage of the second pumping section may be larger than the stage of the first pumping section to offer selective pumping performance.

Optionally, the third pumping section is arranged such that fluid passing therethrough from the second pump inlet follows a different path from fluid passing therethrough from the first pump inlet. For example, the third pumping section may be arranged such that fluid passing therethrough from the first pump inlet follows only part of the path of the fluid passing therethrough from the second pump inlet. Alternatively, the third pumping section may be arranged such that fluid passing therethrough from the first pump inlet follows a path which is separate from the path of the fluid passing therethrough from the second pump inlet. For example, the third pumping stage may comprise a plurality of channels, in which one or more of the channels communicate with the second pump inlet whilst the remaining channels communicate with the first pump inlet.

The third pumping section preferably comprises at least one molecular drag stage. In the preferred embodiments, the third section comprises a multi-stage Holweck mechanism with a plurality of channels arranged as a plurality of helixes. The Holweck mechanism may be positioned relative to the first and second pump inlets such that fluid passing therethrough from the first pump inlet follows only part of the path of the fluid passing therethrough from the second pump inlet.

In one embodiment, the third pumping section comprises at least one Gaede pumping stage and/or at least one aerodynamic pumping stage for receiving fluid entering the pump from each of the first, second and third chambers. The Holweck mechanism may be positioned upstream from said at least one Gaede pumping stage and/or at least one aerodynamic pumping stage, and such that fluid entering the pump from the first pump inlet does not pass therethrough.

The aerodynamic pumping stage may be a regenerative stage. Other types of aerodynamic mechanism may be side flow, side channel, and peripheral flow mechanisms. Preferably, in use, the pressure of the fluid exhaust from the pump outlet is equal to or greater than 10 mbar.

The apparatus may comprise a fourth chamber located between the first and second chambers. In this case, the vacuum pump preferably comprises an optional fourth inlet for receiving fluid from the fourth chamber, the fourth inlet being positioned such that fluid entering the pump from the fourth chamber passes through, of said sections, only the third pumping section towards the pump outlet, and with the fluid entering the pump from the fourth chamber passes through a greater number of stages of the third pumping section than fluid entering the pump from the first chamber.

The pump preferably comprises a drive shaft having mounted thereon at least one rotor element for each of the pumping stages. The rotor elements of at least two of the pumping sections may be located on, preferably integral with, a common impeller mounted on the drive shaft. For example, rotor elements for the first and second pumping sections may be integral with the impeller. Where the third pumping section comprises a molecular drag stage, an impeller for the molecular drag stage may be located on a rotor integral with the impeller. For example, the rotor may comprise a disc substantially orthogonal to, preferably integral with, the impeller. Where the third pumping section comprises a regenerative pumping stage, rotor elements for the regenerative pumping stage are preferably integral with the impeller.

The system preferably comprises a backing pump connected to the pump outlet such that, in use, at least 99% of the fluid mass pumped from the apparatus passes through both the vacuum pump and the backing pump.

In a second aspect, the present invention provides a method of differentially evacuating a plurality of chambers of an apparatus, the method comprising the steps of providing a vacuum pump comprising at least first and second pump inlets each for receiving fluid from a respective chamber and a plurality of pumping stages positioned relative to the inlets so that fluid entering the pump from the first inlet passes through fewer pumping stages than fluid entering the pump from the second inlet, attaching the inlets of the pump to the chambers such that, in use, at least 99% of the fluid mass pumped from the apparatus passes through at least one of the pumping stages of the pump, and operating the pump to generate a first pressure above 0.1 mbar in a first chamber and a second pressure lower than the first pressure in a second chamber.

In a third aspect, the present invention provides a deferentially pumped vacuum system comprising a plurality of pressure chambers; and a vacuum pump attached thereto and comprising a plurality of pump inlets each for receiving fluid from a respective pressure chamber, and a plurality of pumping stages for differentially pumping the chambers; wherein a pumping stage arranged to pump fluid from the pressure chamber in which the highest pressure is to be generated comprises a Gaede pumping stage or an aerodynamic pumping stage. This system may be a mass spectrometer system, a coating system, or other form of system comprising a plurality of differentially pumped chambers. Features described above in relation to the first aspect of the invention are equally applicable to this third aspect of the invention.

In a fourth aspect the present invention provides a method of differentially evacuating a plurality of chambers, the method comprising the steps of providing a vacuum pump comprising a plurality of pump inlets each for receiving fluid from a respective pressure chamber, and a plurality of pumping stages for differentially pumping the chambers; and attaching the pump to the chambers such that a pumping stage for pumping fluid from the pressure chamber in which the highest pressure is to be generated comprises a Gaede pumping stage or an aerodynamic pumping stage.

In a fifth aspect, the present invention provides a compound multi-port vacuum pump comprising first, second and third pumping sections, a first pump inlet through which fluid can enter the pump and pass through each of the pumping sections towards a pump outlet, a second pump inlet through which fluid can enter the pump and pass through only the second and third pumping sections towards the outlet, an optional third pump inlet through which fluid can enter the pump and pass through only the third pumping section towards the outlet, and a fourth inlet through which fluid can enter the pump and pass through only part of the third pumping section towards the outlet.

The present invention also provides a differentially pumped vacuum system comprising a plurality of chambers and a pump as aforementioned for evacuating each of the chambers. The system preferably comprises a backing pump having an inlet connected to the pump outlet for receiving fluid exhaust from the pump.

Features described above in relation to system or pump aspects of the invention are equally applicable to method aspects of the invention, and vice versa.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
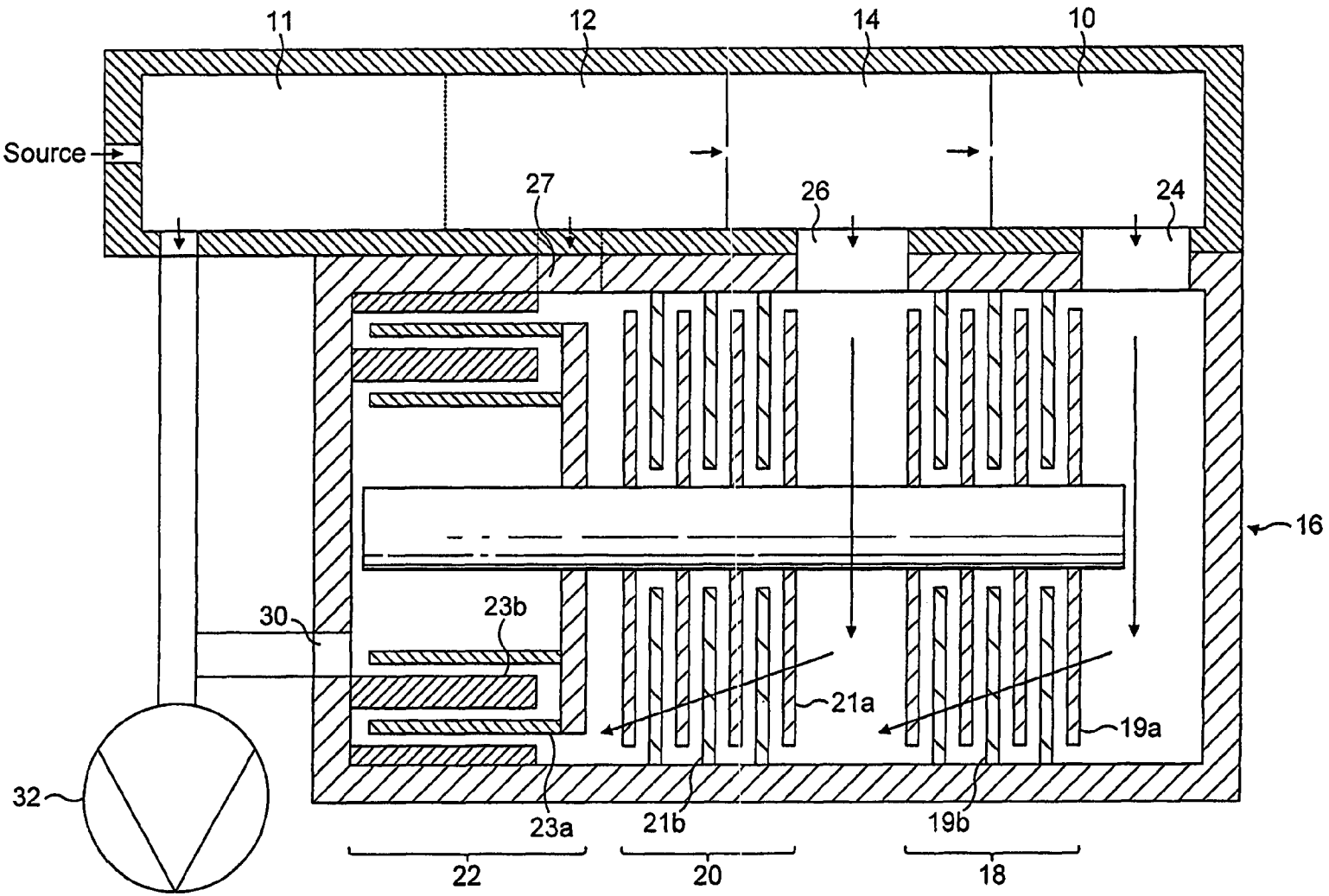
FIG. 1 (PRIOR ART)
FIG. 1 is a simplified cross-section through a known multi port vacuum pump suitable for evacuating a differentially pumped, mass spectrometer system.
Figure 2:
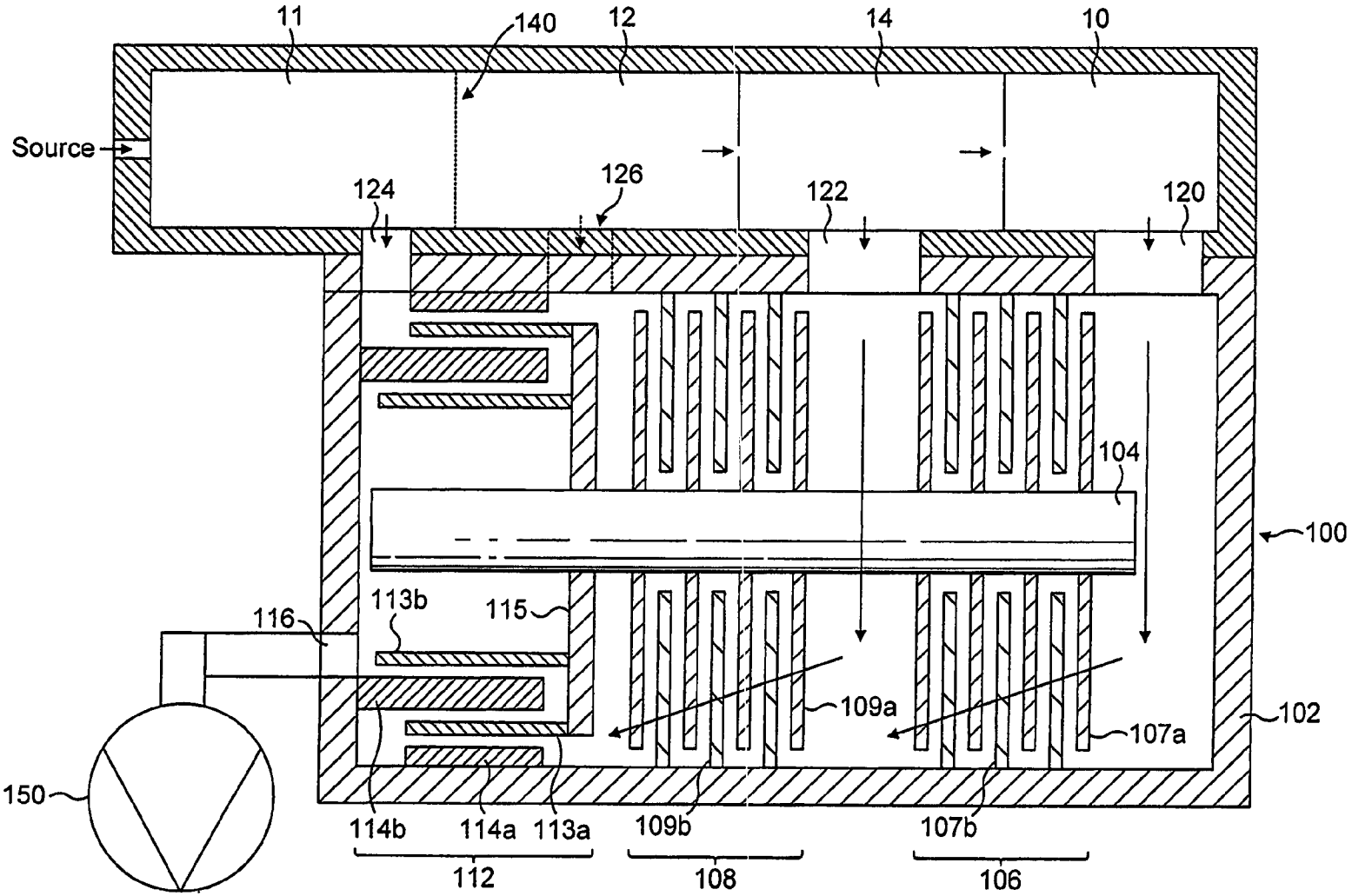
FIG. 2 is a simplified cross-section through a first embodiment of a multi port vacuum pump suitable for evacuating the differentially pumped mass spectrometer system of FIG. 1.

FIG. 2 illustrates a first embodiment of a compound multi port vacuum pump 100 suitable for evacuating more than 99% of the total mass flow in the differentially pumped mass spectrometer system described above with reference to FIG. 1. This is achieved by the vacuum pump 100 being arranged so as to be able to pump directly the highest pressure chamber, in addition to the usual second and third highest pressure chambers. The compound multi port vacuum pump 100 comprises a multi-component body 102 within which is mounted a drive shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

The pump includes at least three pumping sections 106, 108, 112. The first pumping section 106 comprises a set of turbo-molecular stages. In the embodiment shown in FIG. 2, the set of turbo-molecular stages 106 comprises four rotor blades and three stator blades of known angled construction. A rotor blade is indicated at 107*a* and a stator blade is indicated at 107*b*. In this example, the rotor blades 107*a* are mounted on the drive shaft 104.

The second pumping section 108 is similar to the first pumping section 106, and also comprises a set of turbo-molecular stages. In the embodiment shown in FIG. 2, the set of turbo-molecular stages 108 also comprises four rotor blades and three stator blades of known angled construction. A rotor blade is indicated at 109*a* and a stator blade is indicated at 109*b*. In this example, the rotor blades 109*a* are also mounted on the drive shaft 104.

Downstream of the first and second pumping sections is a third pumping section 112 in the form of a molecular drag mechanism, for example, a Holweck drag mechanism. In this embodiment, the Holweck mechanism comprises two rotating cylinders 113*a*, 113*b* and corresponding annular stators 114*a*, 114*b* having helical channels formed therein in a manner known per se. The rotating cylinders 113*a*, 113*b* are preferably formed from a carbon fibre material, and are mounted on a disc 115, which is located on the drive shaft 104. In this example, the disc 115 is also mounted on with the drive shaft 104.

Downstream of the Holweck mechanism 112 is a pump outlet 116. A backing pump 150 backs the pump 100 via outlet 116.

As illustrated in FIG. 2, the pump 100 has three inlets 120, 122, 124; although only three inlets are used in this embodiment, the pump may have an additional, optional inlet indicated at 126, which can be selectively opened and closed and can, for example, make the use of internal baffles to guide different flow streams to particular portions of a mechanism. The low fluid pressure inlet 120 is located upstream of all of the pumping sections. The middle fluid pressure inlet 122 is located interstage the first pumping section 106 and the second pumping section 108. The high fluid pressure inlet 124 may be located upstream of or, as illustrated in FIG. 2, between the stages of the Holweck mechanism 112, such that all of the stages of the Holweck mechanism are in fluid communication with the other inlets 120, 122, whilst, in the arrangement illustrated in FIG. 2, only a portion (one or more) of the stages are in fluid communication with the third inlet 124. The optional inlet 126 is located interstage the second pumping section 108 and the Holweck mechanism 112, such that all of the stages of the Holweck mechanism 112 are in fluid communication with the optional inlet 126.

In use, each inlet is connected to a respective chamber of the differentially pumped mass spectrometer system. Thus, inlet 120 is connected to a low pressure chamber 10, inlet 122 is connected to a middle pressure chamber 14 and inlet 124 is connected to the highest pressure chamber 11. Where another chamber 12 is present between the high pressure chamber 11 and the middle pressure chamber 14, as indicated by the dotted line 140, the optional inlet 126 is opened and connected to this chamber 12. Additional lower pressure chambers may be added to the system, and may be pumped by separate means, however, the mass flow of these additional chambers is typically much less than 1% of the total mass flow of the spectrometer system.

Fluid passing through inlet 120 from the low pressure chamber 10 passes through the first pumping section 106, through the second pumping section 108, through all of the channels of the Holweck mechanism 112 and exits the pump 100 via pump outlet 116. Fluid passing through inlet 122 from the middle pressure chamber 14 enters the pump 100, passes through the second pumping section 108, through all of the channels of the Holweck mechanism 112 and exits the pump 100 via pump outlet 116. Fluid passing through inlet 124 from the high pressure chamber 11 enters the pump 100, passes through at least a portion of the channels of the Holweck mechanism and exits the pump via pump outlet 116. If opened, fluid passing through inlet 126 from chamber 12 enters the pump 100, passes through all of the channels of the Holweck mechanism 112 and exits the pump 100 via pump outlet 116.

In this example, in use, and similar to the system described with reference to FIG. 1, the first interface chamber 11 is at a pressure above 0.1 mbar, preferably around 1-10 mbar, the second interface chamber 12 (where used) is at a pressure of around $10^{-1}$-1 mbar, the third interface chamber 14 is at a pressure of around $10^{-2}$-$10^{-3}$ mbar, and the high vacuum chamber 10 is at a pressure of around $10^{-5}$-$10^{-6}$ mbar.

A particular advantage of the embodiment described above is that, by enabling the high pressure chamber of the differentially pumped mass spectrometer system to be directly pumped by the same compound multi port vacuum pump 100 that pumps the second and third highest pressure chambers, rather than by the backing pump 150, the compound multi port vacuum pump is able to manage more than 99% of the total fluid mass flow of the mass spectrometer system. Thus, the performance of the first chamber and the rest of the internally linked spectrometer system can be increased without increasing the size of the backing pump.

Figure 3:
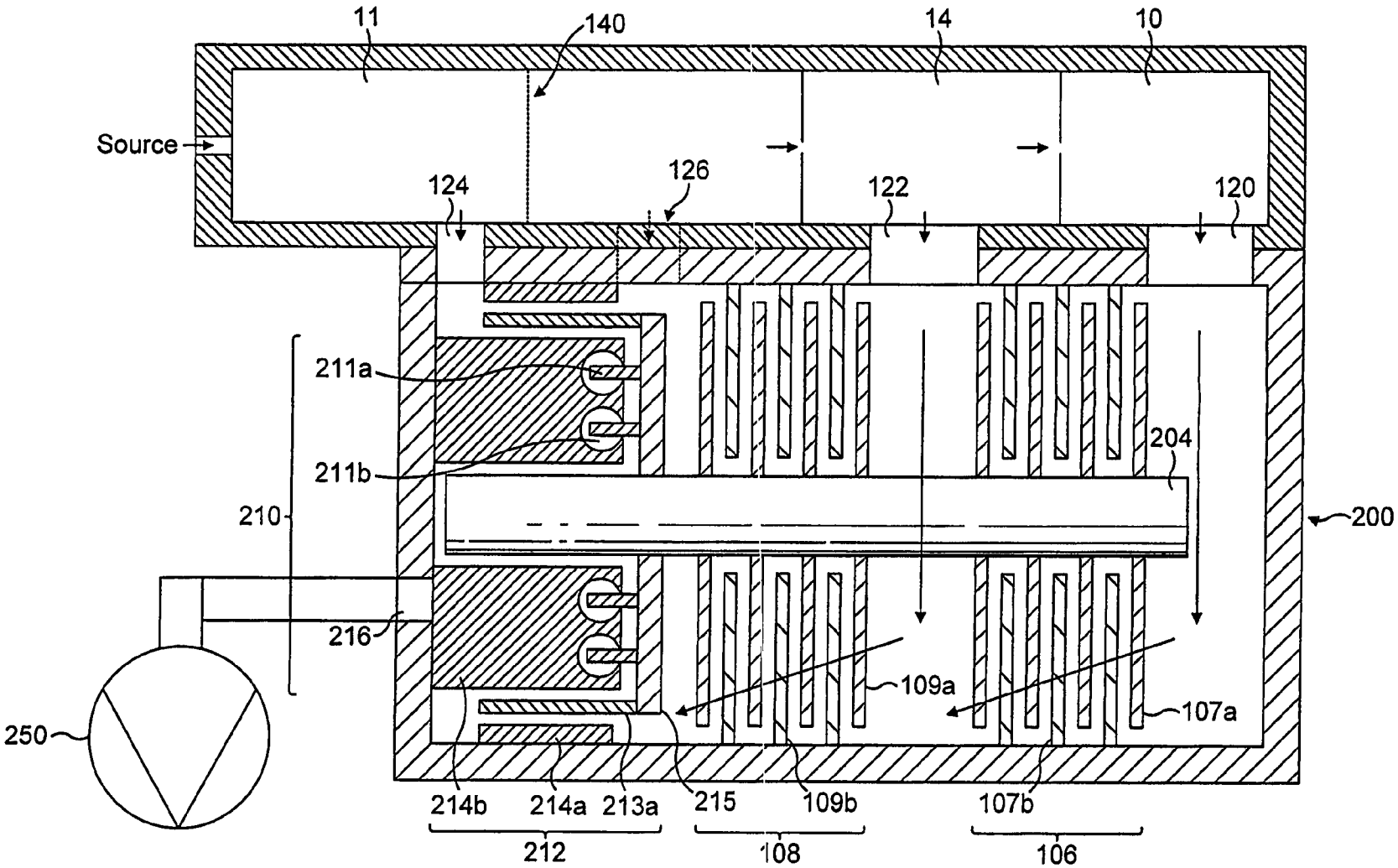
FIG. 3 is a simplified cross-section through a second embodiment of a multi port vacuum pump suitable for evacuating the differentially pumped mass spectrometer system of FIG. 1.

FIG. 3 provides a second embodiment of a vacuum pump 200 suitable for evacuating more than 99% of the total mass flow from a differentially pumped mass spectrometer system and is similar to the first embodiment, save that the third pumping section also includes at least one aerodynamic stage 210, in this example in the form of an aerodynamic regenerative stage, located downstream of the Holweck mechanism 212.

Figure 4:
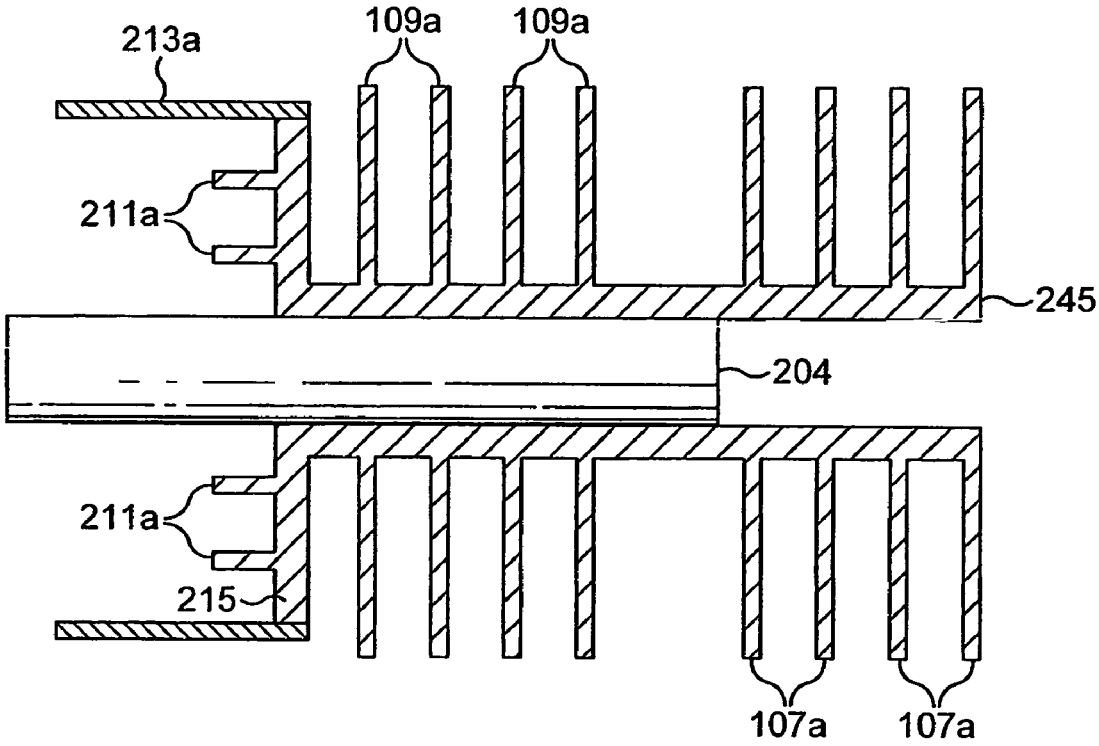
FIG. 4 is a simplified cross-section through the impeller suitable for use in the pump shown in FIG. 3.

The regenerative stage 210 comprises a plurality of rotors in the form of an annular array of raised rings 211*a* mounted on, or integral with, the disc 215 of the Holweck mechanism 212. As illustrated in FIG. 4, in this embodiment, rotors 107, 109, of the turbo-molecular sections 106, 108, the rotating disc 215 of the Holweck mechanism 212 and the rotors 211*a* of the regenerative stage 210 may be located on a common impeller 245, which is mounted on the drive shaft 204, with the carbon fibre rotating cylinder 213*a* of the Holweck mechanism 212 being mounted on the rotating disc 215 following machining of these integral rotary elements. However, only one or more of these rotary elements may be integral with the impeller 245, with the remaining elements being mounted on the drive shaft 204 as in the first embodiment, or located on another impeller, as required. The right (as shown) end of the impeller 245 may be supported by a magnetic bearing, with permanent magnets of this bearing being located on the impeller, and the left (as shown) end of the drive shaft 204 may be supported by a lubricated bearing.

Stator 214*b* of the Holweck mechanism 212 can also form the stator of the regenerative stage 210, and has formed therein an annular channel 211*b* within which the rotors 211*a* rotate. As is known, the channel 211*b* has a cross sectional area greater than that of the individual rotors 211*a*, except for a small part of the channel known as a "stripper" which has a reduced cross section providing a close clearance for the rotors. In use of the pump 200, fluid pumped from each of the chambers of the differentially pumped mass spectrometer system enters the annular channel 211*b* via an inlet positioned adjacent one end of the stripper and the fluid is urged by means of the rotors 211*a* on the rotating disc 215 along the channel 211*b* until it strikes the other end of the stripper, and the fluid is then urged through the outlet 216 situated on that other end of the stripper.

In use, the vacuum pump 200 can generate a similar performance advantage in the chambers of the differentially pumped mass spectrometer system as the vacuum pump 100 of the first embodiment. In addition to the potential performance advantage offered by the first embodiment, this second embodiment can also offer two further distinct advantages. The first of these is the consistency of the system performance when backed by pumps with different levels of performance, for example a backing pump operating directly on line at 50 or 60 Hz.

In the case of this second embodiment it is anticipated that, in the system described with reference to FIG. 3, the variation in system performance will be as low as 1% if the frequency of operation of the backing pump 250 is varied between 50 Hz and 60 Hz, thus providing the user with a flexible pumping arrangement with stable system performance. The second additional advantage of the second embodiment is that by providing an additional pumping stage downstream of the Holweck section, this arrangement of the vacuum pump can enable the capacity, and thus the size, of the backing pump 250 to be significantly reduced in comparison to the first embodiment. This is because, by virtue of the additional pumping section 210, the vacuum pump 200 can exhaust fluid at a pressure of above 10 mbar. In contrast, the vacuum pump 100 of the first embodiment typically exhausts fluid at a pressure of around 1-10 mbar, and so the size of the backing pump 250 can be reduced significantly in comparison to the backing pump 150 of the first embodiment. It is anticipated that this size reduction could be as much as a factor of 10 in some mass spectrometer systems without adversely affecting system performance. As indicated in FIGS. 3 and 4, the rotors 211*a* of the regenerative stage 210 are surrounded by the rotating cylinder 213*a* of the Holweck section 212. Thus, the regenerative section 210 can be conveniently included in the vacuum pump 100 of the first embodiment with little, or no, increase in the overall length of the vacuum pump. Thus, the whole pumping system of the second embodiment, including both vacuum pump 200 and backing pump 250, could be reduced in size and possibly conveniently housed within a bench-top mounted enclosure.

Figure 5:
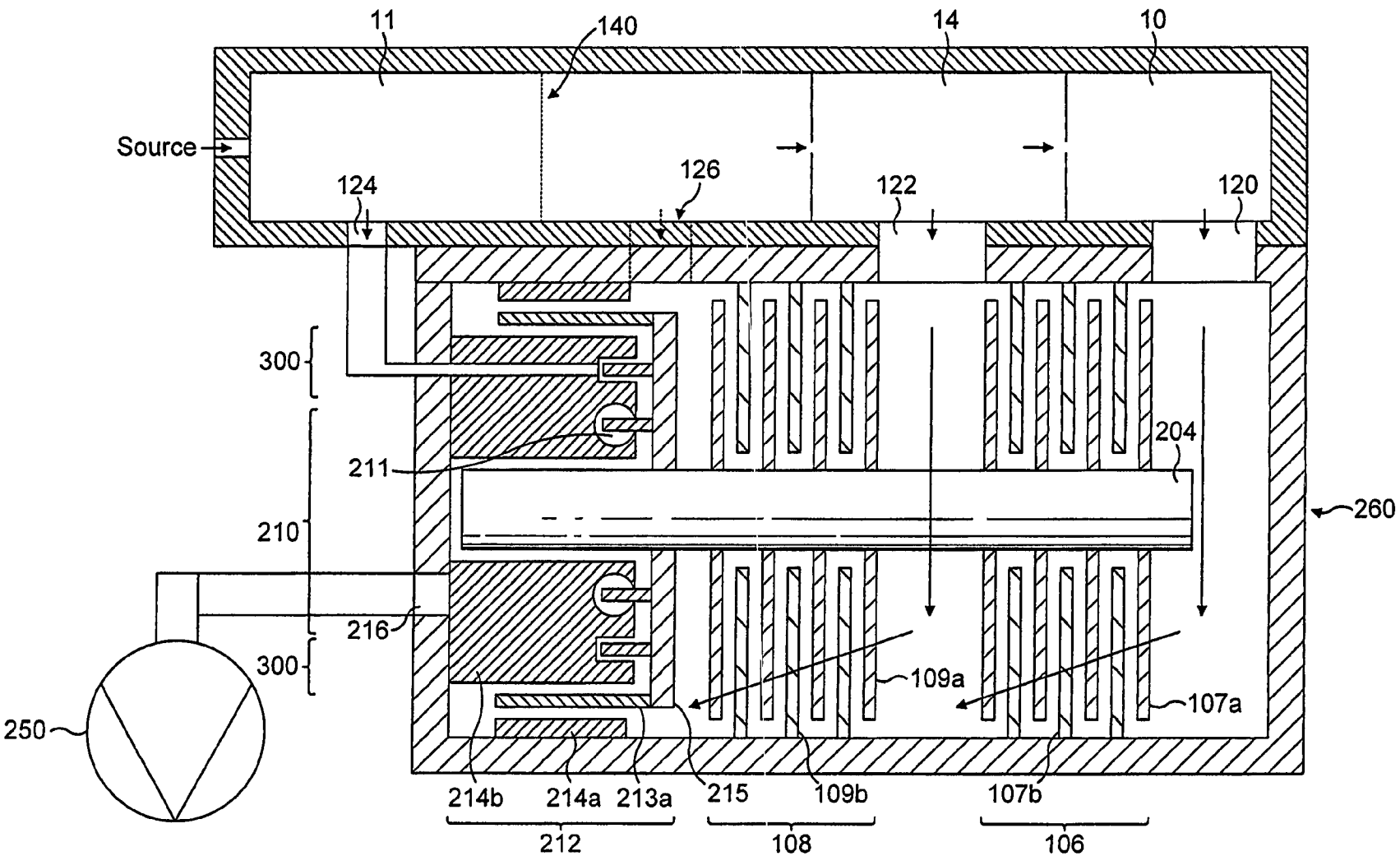
FIG. 5 is a simplified cross-section through a third embodiment of a multi port vacuum pump suitable for evacuating the differentially pumped mass spectrometer system of FIG. 1.

FIG. 5 provides a third embodiment of a vacuum pump 260 suitable for evacuating more than 99% of the total mass flow from a differentially pumped mass spectrometer system and is similar to the second embodiment, save that fluid passing through inlet 124 from the high pressure chamber 11 enters the pump 250, passes through the aerodynamic stage 210 without passing through the Holweck mechanism 212, and exits the pump via pump outlet 216. Furthermore, as shown in FIG. 5, at least part of the aerodynamic pumping stage 210 may be replaced by a Gaede, or other molecular drag, mechanism 300. The extent to which the aerodynamic pumping stage 210 is replaced by a Gaede mechanism 300 depends on the required pumping performance of the vacuum pump 260. For example, the regenerative stage 210 may be either wholly replaced or, as depicted, only partially replaced by a Gaede mechanism.

In summary, a differentially pumped mass spectrometer system comprising a mass spectrometer having a plurality of pressure chambers; and a vacuum pump attached thereto and comprising a plurality of pump inlets each for receiving fluid from a respective pressure chamber and a plurality of pumping stages for differentially pumping fluid from the chambers; whereby, in use, at least 99% of the fluid mass pumped from the spectrometer passes through one or more of the pumping stages of the vacuum pump.

We claim:

1. A compound multi-port vacuum pump comprising first, second and third pumping sections, a first pump inlet through which fluid can enter the pump and pass through each of the pumping sections towards a pump outlet, a second pump inlet through which fluid can enter the pump and pass through only the second and third pumping sections towards the outlet, an optional third pump inlet through which fluid can enter the pump and pass through only the third pumping section towards the outlet, and a fourth inlet through which fluid can enter the pump and pass through only part of the third pumping section towards the outlet.

2. The pump according to claim 1 wherein at least one of the first and second pumping sections comprises at least one turbo-molecular stage.

3. The pump according to claim 1 wherein both of the first and second pumping sections comprises at least one turbo-molecular stage.

4. The pump according to claim 1 wherein the third pumping section is positioned relative to the second and forth pump inlets such that fluid passing therethrough from the second pump inlet follows a different path from fluid passing therethrough from the fourth pump inlet.

5. The pump according to claim 4 wherein the third pumping section is positioned relative to the second and forth pump inlets such that fluid passing therethrough from the forth pump inlet follows only part of the path of the fluid passing therethrough from the second pump inlet.

6. The pump according to claim 1 wherein the third pumping section comprises at least one molecular drag stage.

7. The pump according to claim 6 wherein the third pumping section comprises a multi-stage Holweck mechanism with a plurality of channels arranged as a plurality of helixes.

8. The pump according to claim 7 wherein the Holweck mechanism is positioned relative to the second and forth pump inlets such that fluid passing therethrough from the forth pump inlet follows only part of the path of the fluid passing therethrough from the second pump inlet.

9. The pump according to claim 7 wherein the third pumping section comprises at least one Gaede pumping stage and/or at least one aerodynamic pumping stage, and wherein the Holweck mechanism is positioned upstream from said at least one Gaede pumping stage and/or at least one aerodynamic pumping stage.

10. The pump according to claim 9 wherein the Holweck mechanism is positioned relative to the second and fourth pump inlets such that fluid entering the pump from the fourth pump inlet does not pass therethrough.

11. The pump according to claim 9 wherein the third pumping section comprises at least one aerodynamic pumping stage and wherein, in use, the pressure of the fluid exhaust from the pump outlet is equal to or greater than 10 mbar.

12. The pump according to claim 11 wherein the third inlet is positioned such that fluid entering the pump therethrough passes through, of said sections, only the third pumping section towards the pump outlet.

13. The pump according to claim 12 wherein the fluid entering the pump through the third inlet passes through a greater number of stages of the third pumping section than fluid entering the pump through the fourth inlet.

14. The pump according to claim 1 wherein the fluid pumping section comprises at least one Gaede pumping stage and/or at least one aerodynamic pumping stage.

15. The pump according to claim 14 wherein said at least one aerodynamic pumping stage comprises at least one regenerative stage.

16. The pump according to claim 1 comprising a drive shaft having mounted thereon at least one rotor element for each of the pumping section.

17. The differentially pumped vacuum system comprising a plurality of chambers and a pump according to claim 1 for evacuating each of the chambers.

* * * * *